US006994120B2

(12) United States Patent
Speich

(10) Patent No.: US 6,994,120 B2
(45) Date of Patent: Feb. 7, 2006

(54) PATTERNED FABRIC AND A METHOD FOR THE PRODUCTION THEREOF

(75) Inventor: Francisco Speich, Gipf-Oberfrick (CH)

(73) Assignee: Brevitex Etablissement pour l' Exploitation de Brevets Textiles, Liechtenstein ( * ) Notice: Subject to any disclaimer, the term of this patent is extended or adjusted under 35 U.S.C. 154(b) by 264 days.

(21) Appl. No.: 10/468,530

(22) PCT Filed: Feb. 14, 2002

(86) PCT No.: PCT/CH02/00088

§ 371 (c)(1),
(2), (4) Date: Aug. 19, 2003

(87) PCT Pub. No.: WO02/066720

PCT Pub. Date: Aug. 29, 2002

(65) Prior Publication Data

US 2004/0065380 A1 Apr. 8, 2004

(30) Foreign Application Priority Data

Feb. 20, 2001 (CH) ..... 299/01
Jun. 6, 2001 (CH) ..... 1027/01

(51) Int. Cl.
*D03D 45/32* (2006.01)

(52) U.S. Cl. ..... 139/1 R; 139/232 R

(58) Field of Classification Search ..... 139/1 R, 139/232, 453, 317
See application file for complete search history.

(56) References Cited

U.S. PATENT DOCUMENTS 3,749,139 A * 7/1973 Rath ..... 139/416
6,390,143 B1 5/2002 Speich

FOREIGN PATENT DOCUMENTS

| | | |
|---|---|---|
| DE | 44 38 535 | 5/1996 |
| EP | 0 509 186 | 10/1992 |
| FR | 2 782 526 | 2/2000 |
| TW | 340880 | 8/1986 |
| WO | 98/29588 | 7/1998 |
| WO | 00/60151 | 10/2000 |

* cited by examiner

*Primary Examiner*—John J. Calvert
*Assistant Examiner*—Robert H. Muromoto
(74) *Attorney, Agent, or Firm*—Ostrolenk, Faber, Gerb & Soffen, LLP; Klaus P. Stoffel

(57) ABSTRACT

A patterned fabric having warp threads and weft threads that form an illustration. The weft threads are arranged to form a threaded group and, together with at least one warp thread, form a cell. The weft threaded are tied off in the cell by the warp thread so that the cell has a defined color impression. The cell has weaves formed irregularly in a warp direction and a weft direction by at least two of the warp threads and two of the weft threads without periodic repetition.

12 Claims, 8 Drawing Sheets

PATTERNED FABRIC AND A METHOD FOR THE PRODUCTION THEREOF

This application is a U.S. National stage of PCT/CH02/00088, filed Feb. 14, 2002 and claims priority from Swiss Application No. 299/01, filed Feb. 20, 2001 and Swiss Application No. 1027/01, filed Jun. 6, 2001.

TECHNICAL FIELD

The invention relates to a patterned fabric, in particular a Jacquard fabric and to a method for producing it.

PRIOR ART

WO 00/60151 describes a patterned fabric and a method for producing it in the fabric technique with warp threads which form a shed and with weft threads. In this method, at least four weft threads of different basic colors, which form a thread group, are inserted in a defined constant sequence, in such a way that, together with a warp thread, a constant cell is formed. The weft threads are tied off by means of regular weaves with repeat repetition, in such a way that a color cell with a defined color impression is obtained. To produce a Jacquard fabric with an illustration, a weaving program is set up. For this purpose, the illustration present on a model is broken down into weavable image dots or color cells. In this case, the mixed colors in the fabric are produced on the basis of the low resolution of the human eye.

It has become clear, then, that the use of regular weaves has a greater influence on the illustration reproduced in the fabric. Although a large number of color shades can be generated, the nuances generated in the color breakdown used today are not always reproduced by means of the repeat repetition. Quality differences between the illustration to be woven and the woven illustration consequently occur, this being a disadvantage.

DE 44 38 535 discloses a method for the Jacquard weaving of colored cloth. In this method, an illustration to be woven is broken down by means of the screening method known from printing technology. In this method, a model is transferred into a computer by scanning and is indicated on the display unit, a very large number of color shades being present. The colors are subsequently reduced to an illustratable or desired number of colors. Finally, this number of colors is broken down into screen dots, that is to say into image dots having the colors red, yellow and blue and also black and white, the screen dot having the size of a weavable dot. After the color breakdown, the weaving program is set up by means of computer technology, each screen dot corresponding to a weaving dot. These weaving dots are tied off according to the classic Jacquard method, that is to say regular weaves with repeat repetitions are employed.

The known method has substantial disadvantages. An experienced person skilled in the art with weave experience is absolutely necessary in order to carry out the method. To be precise, it became clear that, in woven colored illustrations in the colors yellow, red and blue, the color mix is faulty, that is to say they do not have all the colored shades of the model. Normally, corrections are necessary in order to improve the woven illustration. However, such corrections can be carried out only by an experienced person skilled in the art with weave experience. In the color breakdown for reproduction graphics, it is to be assumed that a color mix occurs in the region between the print colors during the printing operation. In other words, the printed color dots are not delimited with high definition, but, instead, the print colors of the adjacent color dots flow partially one into the other in the edge region. In the known method, the illustration is broken down into screen dots which form a weaving dot with high-definition delimitation. The mixing effects are to be generated owing to the low resolution of the human eye.

SUMMARY OF THE INVENTION

The object of the invention is to improve the initially mentioned patterned fabric, in particular Jacquard fabric, and the initially mentioned method for producing it.

a. the patterned fabric according to claim 1; and b. the method for producing the fabric according to claim 11.

The fabric according to the invention consists of warp threads and weft threads which form a thread group and are tied off by means of a warp thread in a cell in such a way that the cell has a defined color impression. The cell is formed by at least two warp threads and two weft threads, without repeat repetition, by means of weaves which are irregular in the warp direction and the weft direction.

An improved reproduction of the illustration to be woven is advantageously achieved in the fabric by means of the irregular weave.

It is advantageous if the irregular weave is predetermined according to the [lacuna] during the image breakdown of the illustration, because the desired color impression is copied directly by the weave.

For this purpose, at least one weft thread of the thread group can cross at least one warp thread, above the latter, on the face side of the fabric, so that a dot is illustrated by a color. In order to illustrate nuances of the color, further weft threads of the thread group may be arranged above the warp thread. In this case, the weft threads may also float.

Advantageously, the fabric has weft threads of different basic color. In the case of a black/white illustration, the thread group may consist of weft threads in the colors black and white. In a colored illustration, the thread group advantageously comprises weft threads in the basic colors red, green, blue, yellow, black and white or magenta, cyan, yellow, black and white.

For larger single-colored regions, it is advantageous if a regular weave is provided.

It is advantageous if the weft threads on the face side of the fabric float over a maximum of forty-eight warp threads, because the face side of the fabric thereby leaves a better impression. Since the weft threads on the back side of the fabric float over a minimum of four warp threads, the overall impression of the fabric is advantageously improved.

Various methods for producing the patterned fabric from weft threads and warp threads are possible. In one embodiment of the inventive method, a file format is set up from a model of the illustration to be woven, and the illustration to be woven is broken down into pixels consisting of at least four selected basic colors. According to the invention, each basic color is broken down into pixels with a color depth of 8 bits. The pixels of the basic colors are in each case stored on a separate bitmap, and the color depth is subsequently reduced to 2 bits for each basic color. Thereafter, the bitmaps of the basic colors are each offset by the amount of one pixel and are subsequently assembled to form a further bitmap having the basic colors. By means of this bitmap, a weaving program for a Jacquard weaving machine is set up, which provides for the use of irregular weaves without weave repeat repetitions and according to which the fabric is produced on the Jacquard weaving machine.

By means of the electronic image processing according to the method, from a predetermined file format a file format is set up which has a high resolution and constitutes a true-to-original reproduction of the illustration in the fabric. The file format is transferred into a weaving program and converted into a weavable data format. The advantage of this is that the image dots can be generated according to the predetermined file format without manual corrections-by a person skilled in the art with weave experience. By the use of irregular weaves without repeat repetition, image dots in the basic colors in the fabric are generated which, by virtue of the high resolution, result in the true-to-original reproduction of the illustration of the model.

In the reduction of the color depth, with a threshold value being included, the color depth of the basic colors can be influenced in an advantageous way.

By the bitmaps being offset by the amount of one pixel in the warp direction or the weft direction, the fabric density can be improved in an advantageous way.

In addition to the colors known from image processing, other or up to sixteen colors may advantageously also be selected.

By means of a CAD system, in setting up the weaving program, the weaves are fixed by means of the data of the further bitmap and a predetermined warp/weft thread ratio is included. The advantage of this is that the setting up of a weaving program can be simplified and the outlay necessary for this purpose can be reduced.

With the weft threads being inserted in a constant sequence, the design of the insertion device can advantageously be simplified. Advantageously, the sequence of the basic color of the weft threads during insertion is freely selectable, so that the illustration to be woven can be adapted to the color impression of the model.

A weft thread of the thread group may be tied off in such a way that the weft thread crosses over a warp thread on the face side of the fabric. A color dot is thereby advantageously formed. Two or more weft threads may also be tied off in such a way that a color mix effect is achieved.

BRIEF DESCRIPTION OF THE DRAWINGS

Exemplary embodiments of the invention are explained in more detail below by means of drawings in which.

DETAILED DESCRIPTION OF THE INVENTION

Figure 1:
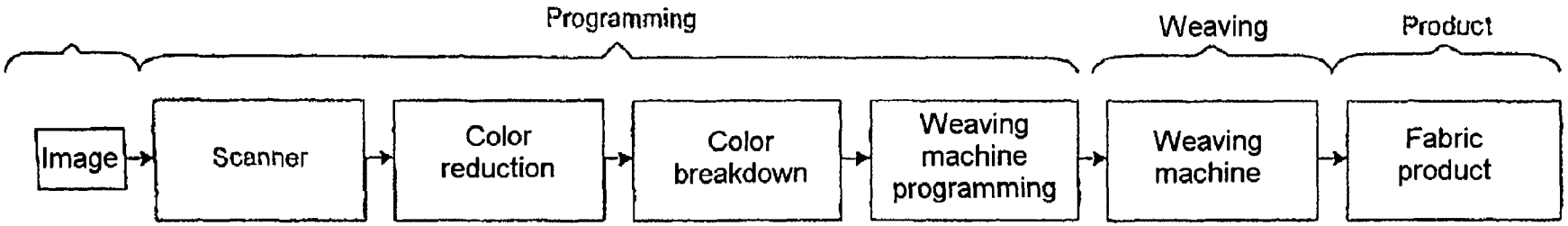
FIG. 1 shows a block diagram of one embodiment of an operation for producing a Jacquard fabric with an illustration.

Reference is made to FIGS. 1 to 4. FIG. 1 shows, in the form of a block diagram, the steps necessary for producing a Jacquard fabric with an illustration.

Figure 2:
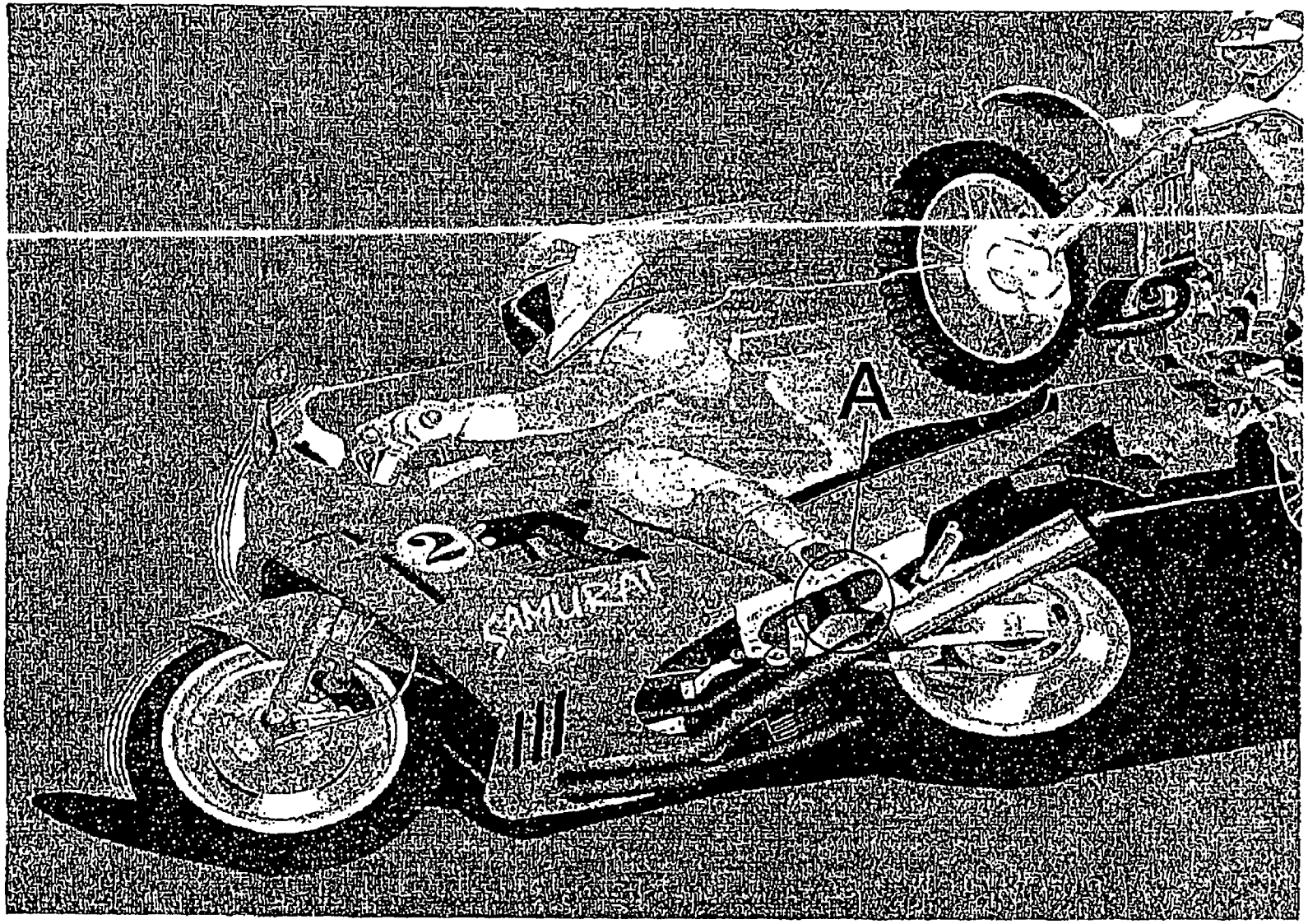
FIG. 2 shows a copy of a model of an illustration to be woven.
Figure 3:
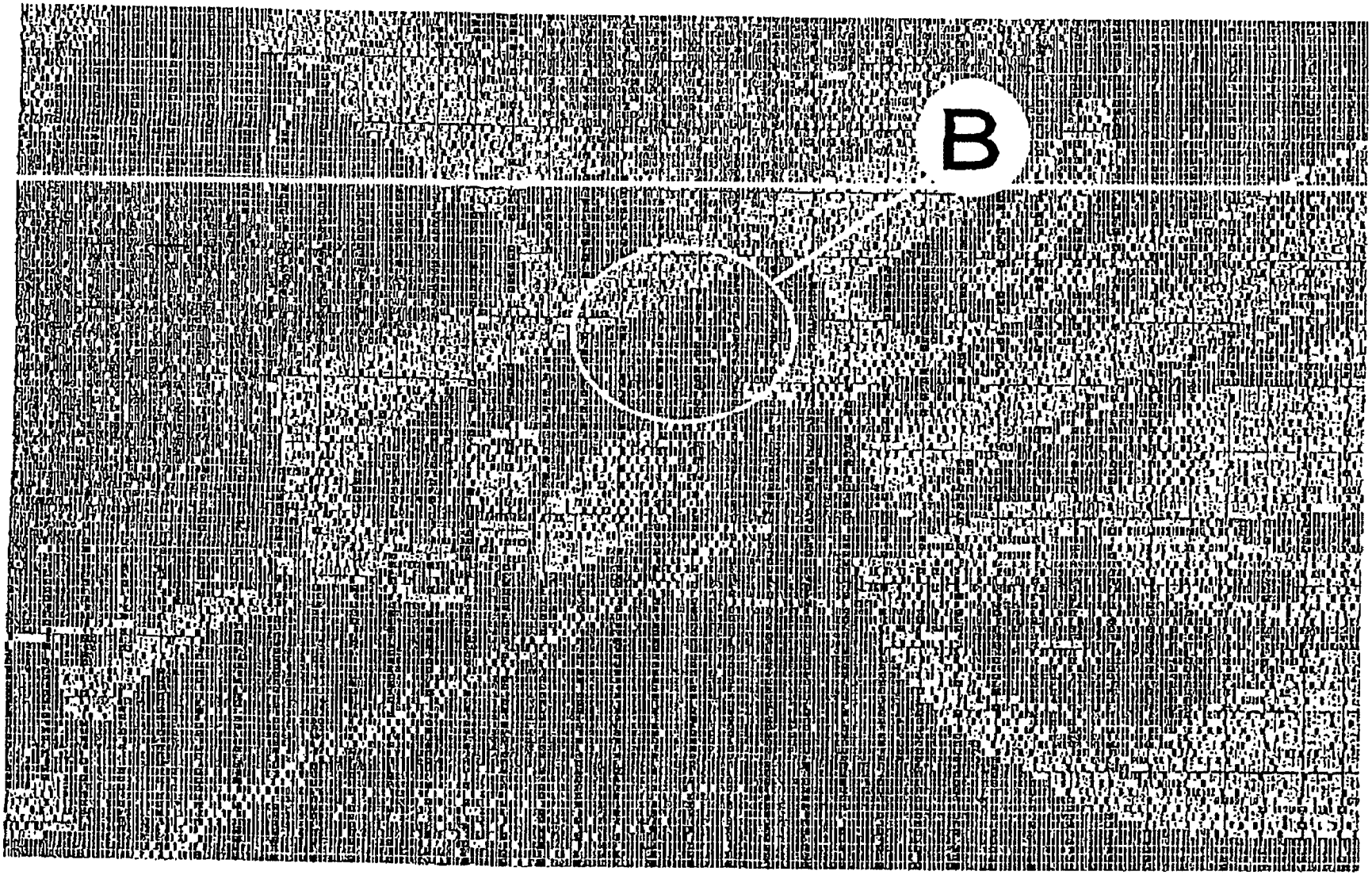
FIG. 3 shows an enlarged detail A of the model according to FIG. 2 on a larger scale after the color breakdown of the illustration in selected basic colors.
Figure 4:
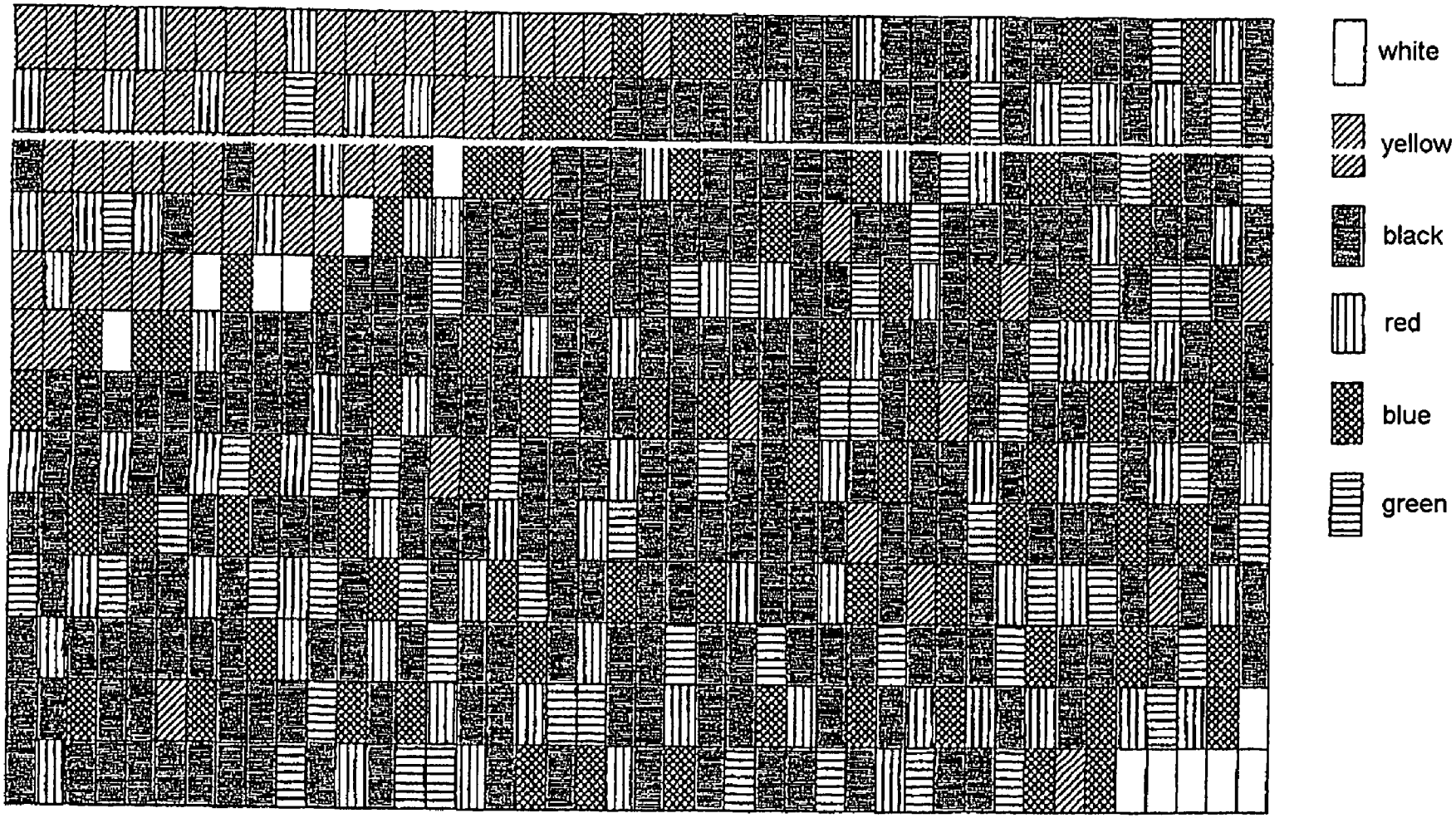
FIG. 4 shows an enlarged detail B in FIG. 3.

FIG. 2 shows a model with the illustration to be woven, which is converted into image dots by color breakdown and forms the basis for a weaving program (FIG. 2 and 3). A version of a fabric according to the invention, which is described below, is then produced by means of a Jacquard weaving machine.

Figure 5:
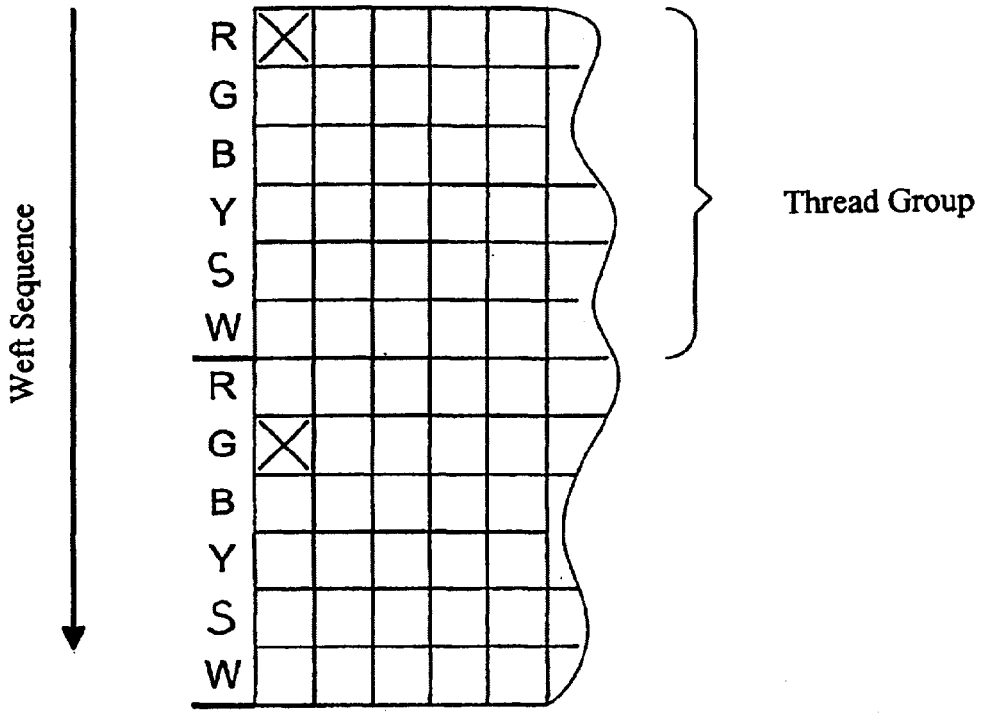
FIG. 5 shows a paper weave design for an irregular weave.
Figure 8:
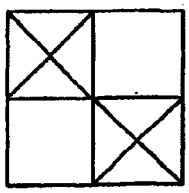
FIG. 8 shows a paper weave design for a regular weave.
Figure 6:
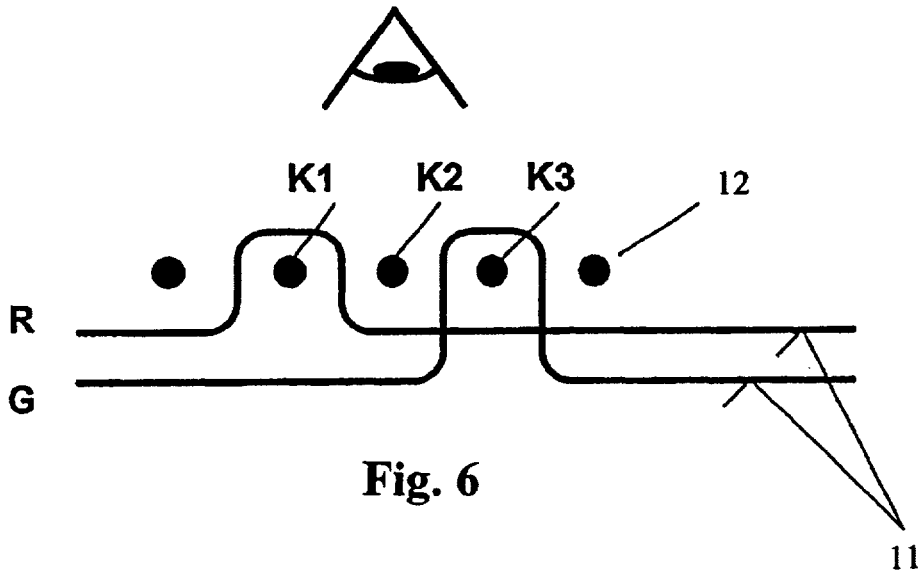
FIG. 6 shows a sectional illustration of a fabric with an irregular weave.
Figure 7:
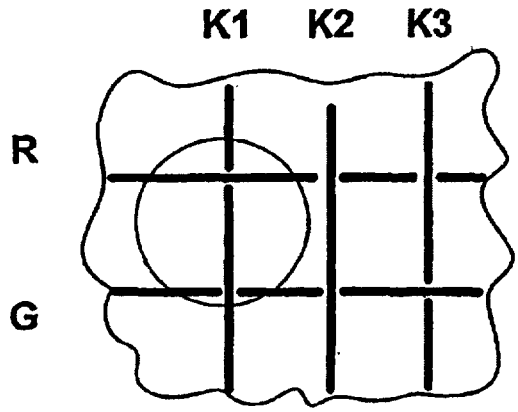
FIG. 7 shows a top view of the fabric according to FIG. 6.

FIG. 5 shows a paper weave design for the fabric to be produced, according to which weft threads in the basic colors red R, green G, blue B, yellow Y, black S and white W are inserted in a defined sequence. The insertion of the weft threads and the movement of the warp threads (upstroke and downstroke) are regulated by means of this paper weave design. The weave is obtained according to the image dots generated during the color breakdown of the illustration. As FIG. 5 shows, a red and a green image dot are to be generated in the fabric. On the basis of the instructions of the paper weave design, the warp thread K1 is located in the bottom shed and the other warp threads are located in the top shed, so that, after the tie-off, the red weft thread crosses the warp thread K1 above the latter and the green weft thread crosses the warp thread K2 above the latter (FIG. 6 and 7). A plurality of weft threads with different colors may also be tied off in the same way, in order to obtain a color mix or color nuance.

As FIG. 6 shows, the weft threads 11 float on the back side of the fabric. It is likewise possible for the weft threads 11 to float on the face side of the fabric. In order to improve the fabric structure, the floating length of the weft threads is limited, specifically over a minimum of four warp threads 12 on the back side and over a maximum of forty-eight warp threads 12 on the face side.

If an illustration to be woven has a relatively large single-colored region, the weft threads in the fabric are tied off by means of a regular weave.

Figure 9:
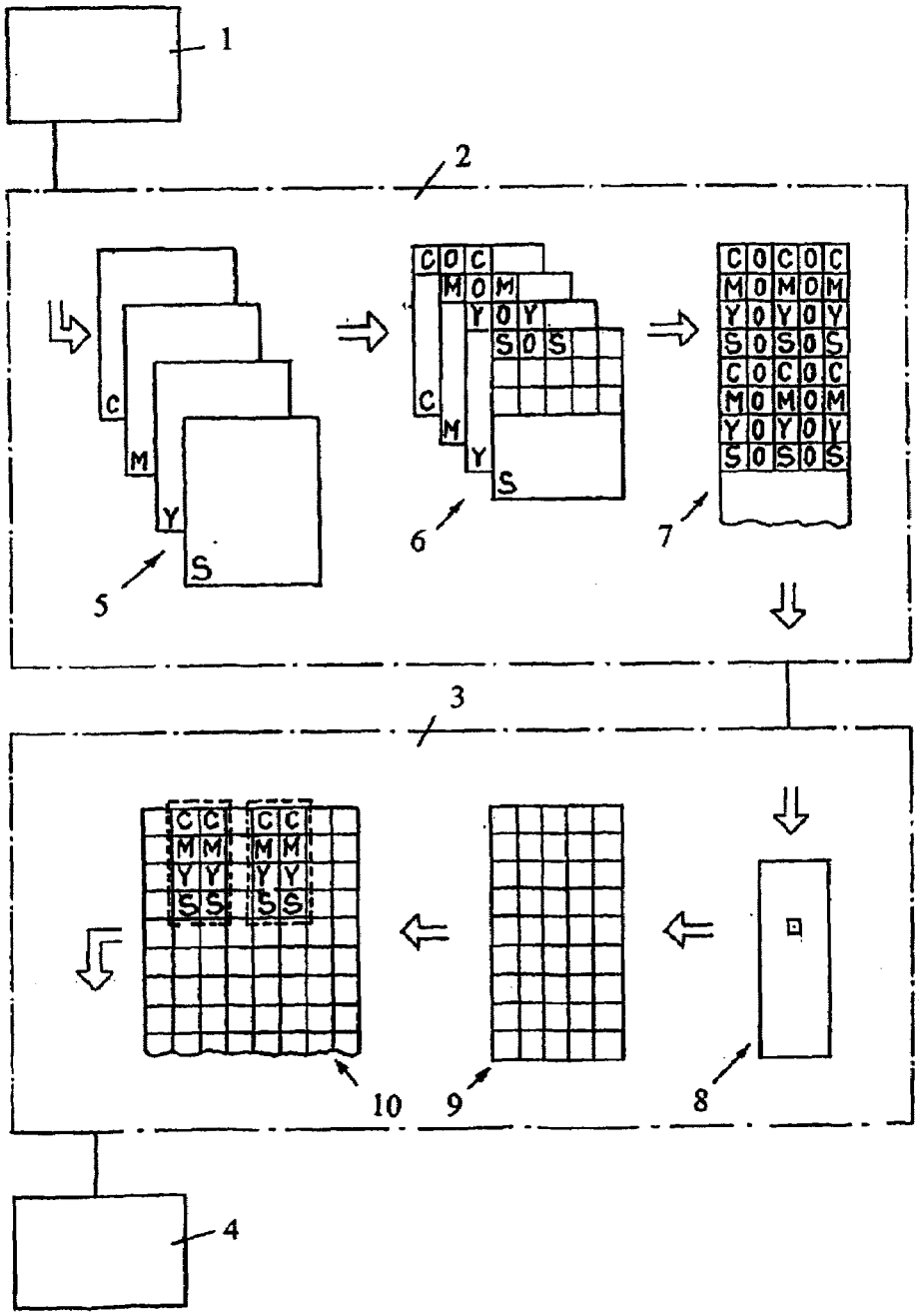
FIG. 9 shows a block diagram of a further embodiment of the method according to the invention for producing a fabric with a colored pattern.

In a further exemplary embodiment according to FIG. 9, the method comprises image preparation 1, image breakdown 2, weaving program set-up 3 and weaving 4. In the image preparation, by means of scanning from a model, for example a photograph, image data in a TIFF file format are read into a program for image processing and are presented, as an image of the illustration to be woven, on a display unit. Depending on the resolution of the scanner and of the display unit, the image illustration which appears on the display unit has a few thousand colors or color shades.

Image breakdown is carried out on the basis of the illustration on the display unit. In the image breakdown, first the basic colors cyan C, magenta M, yellow Y and black S, which are used during weaving, are selected. Thereupon, the image colors are broken down into the basic colors and are stored in a separate bitmap 6 in pixels with a color depth of 8 bits for each basic color. Subsequently, the color depth is reduced in each case to 2 bits, with the result that a square pixel is formed. In this case, by means of a threshold value, the gray steps are broken down into the basic colors C, M, Y, S or white O and the basic color of the pixel is thus fixed. Finally, the bitmaps of the basic colors are offset by the amount of one pixel in the weft direction and are assembled on a further bitmap 7. Owing to the offset by the amount of one pixel, the weft sequence of the weft threads in the basic colors cyan, magenta, yellow, black and white is fixed at the same time. These data are read in a TIFF file format into a CAD system 8 and presented on the display unit.

From this data, a weaving program for the Jacquard weaving machine is set up, which provides for the use of irregular weaves without weave repeat repetitions. With the aid of the illustration, the weaves are fixed by means of the read-in data and with a warp/weft thread ratio being included. In this case, the data are illustrated as square pixels and transferred into a pattern card 9 which, on the display unit, show the pixels as square image dots of the illustration to be woven. Subsequently, the weaving card 10, by means of which the Jacquard weaving machine is controlled, is set up.

During weaving, five weft threads 11 are inserted, in the weft sequence of cyan, magenta, yellow, black and white, as a thread group in a weft line. The weft threads are tied off by means of warp threads 12 in a cell which is formed by two warp threads and at least two weft threads by means of a weave without weave repeat repetition.

Figure 10:
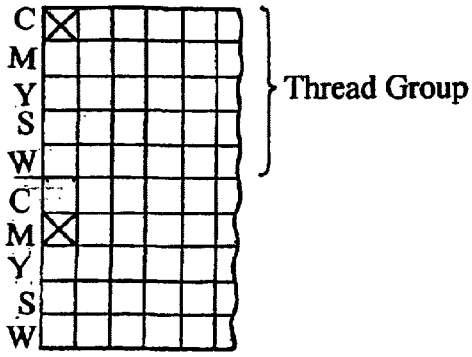
FIG. 10 shows a paper weave design for an irregular weave.
Figure 11:
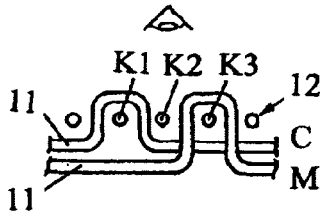
FIG. 11 shows a sectional illustration of a fabric with an irregular weave.
Figure 12:
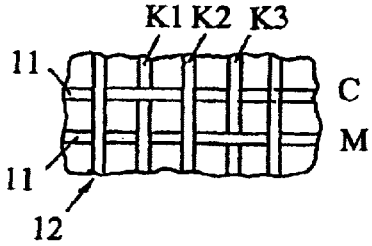
FIG. 12 shows a top view of the fabric according to FIG. 11.

FIG. 10 shows a paper weave design for the fabrics to be produced, which is derived from the weaving program. The insertion of the weft threads and the movement of the warp threads (upstroke and downstroke) are regulated by means of this paper weave design. The weave is obtained according to the image dots generated during the color breakdown of the illustration. According to FIG. 10, an image dot with the basic color cyan and an image dot with the basic color magenta are to be generated in the fabric. On the basis of the instructions of the paper weave design, the warp thread K1 is located in the bottom shed and the other warp threads are located in the top shed, so that, after the tie-off, the weft thread with the basic color magenta crosses the warp thread K3 above the latter (FIG. 11 and FIG. 12). A plurality of weft threads with different colors may also be tied off in the same way, in order to obtain a color mix or color nuance.

What is claimed is:

1. A method for producing a patterned fabric having weft threads and warp threads that form an illustration, the method comprising the steps of: preparing an image; image breakdown of the illustration to be woven into pixels consisting of at least four selected basic colors; setting up a weaving program for a Jacquard weaving machine; and weaving the fabric on the Jacquard weaving machine, the breakdown of the illustration including storing each basic color in pixels with a color depth of 8 bits in each case in a separate bitmap, reducing the color depth to 2 bits for each basic color, offsetting the bitmaps of the basic colors in each case by an amount of one pixel and subsequently assembling the pixels to form a further bitmap having the basic colors, the weaving program for the Jacquard machine being set up to provide for using irregular weaves without weave repeat repetitions, the weaving step including inserting the weft threads as a thread group and tying off the weft threads in a cell which is formed by at least two warp threads and two weft threads by means of a weave without repeat repetition.

2. The method according to claim 1, wherein the reducing of the color depth includes breaking down gray steps into a basic color or white, with a threshold value being included.

3. The method according to claim 1, wherein the bitmaps are offset by the amount of one pixel in at least one of a weft direction and a warp direction.

4. The method according to claim 1, including using one of cyan (C), magenta (M), yellow (Y), black (S) and white (W) as basic colors.

5. The method according to claim 1, including using the basic colors red (R), green (G), blue (B) and yellow (Y), black (S) and white (W).

6. The method according to claim 1, including using up to sixteen basic colors.

7. The method according to claim 1, wherein the step of setting up the weaving program includes fixing the weaves using data of the further bitmap by means of a CAD system.

8. The method according to claim 5, wherein the setting up of the weaving program includes a predetermined warp/weft thread ratio.

9. The method according to claim 1, including setting up a pattern card.

10. The method according to claim 1, wherein the thread group consists of weft threads with different basic colors, which are inserted in a defined constant sequence and are tied off in a cell by means of at least one warp thread.

11. The method according to claim 10, wherein at least one weft thread of the thread group is tied off so that the weft thread crosses over at least one warp thread on a face side of the fabric.

12. The method according to claim 10, including using warp threads that are at least one of white and black.

* * * * *